US011204186B2

(12) United States Patent
Reichl et al.

(10) Patent No.: US 11,204,186 B2
(45) Date of Patent: Dec. 21, 2021

(54) TERMINAL DEVICE FOR A TUBULAR HEATING DEVICE WITH INTEGRATED FUSE

(71) Applicant: BLECKMANN GMBH & CO. KG, Lamprechtshausen (AT)

(72) Inventors: Martin Reichl, Lamprechtshausen (AT); Georg Görg, Lamprechtshausen (AT); Peter Melcher, Lamprechtshausen (AT)

(73) Assignee: BLECKMANN GMBH & CO. KG, Lamprechts Hausen (AT)

( * ) Notice: Subject to any disclaimer, the term of this patent is extended or adjusted under 35 U.S.C. 154(b) by 560 days.

(21) Appl. No.: 15/739,017

(22) PCT Filed: Jun. 24, 2016

(86) PCT No.: PCT/EP2016/064737
§ 371 (c)(1),
(2) Date: Apr. 18, 2018

(87) PCT Pub. No.: WO2016/207392
PCT Pub. Date: Dec. 29, 2016

(65) Prior Publication Data

US 2018/0266725 A1 Sep. 20, 2018

(30) Foreign Application Priority Data

Jun. 24, 2015 (EP) ..... 15173708

(51) Int. Cl.
*F24H 1/20* (2006.01)
*A47L 15/42* (2006.01)
(Continued)

(52) U.S. Cl.
CPC ..... *F24H 1/202* (2013.01); *A47L 15/4285* (2013.01); *D06F 39/04* (2013.01);
(Continued)

(58) Field of Classification Search
CPC ..... F24H 1/202; F24H 9/2071; F24H 1/10; A47L 15/4285; D06F 39/045;
(Continued)

(56) References Cited

U.S. PATENT DOCUMENTS

| | | | | |
|---|---|---|---|---|
| 7,496,284 | B2 * | 2/2009 | Pleschinger | H05B 3/44 392/480 |
| 2010/0033295 | A1 * | 2/2010 | Kent | H01B 1/12 337/405 |
| 2013/0200985 | A1 * | 8/2013 | Colombo | H01H 37/761 337/205 |

FOREIGN PATENT DOCUMENTS

| | | |
|---|---|---|
| CN | 2048623 U | 11/1989 |
| CN | 2050217 U | 12/1989 |

(Continued)

*Primary Examiner* — Sang Y Paik
*Assistant Examiner* — Diallo I Duniver
(74) *Attorney, Agent, or Firm* — Seed Intellectual Property Law Group LLP

(57) ABSTRACT

A terminal device for connecting a heating apparatus with an electricity supply, in particular for a tubular heating apparatus for household appliances, wherein the heating apparatus includes at least one electric resistance heating element, comprises a mounting and reception section arranged for being electrically connected with the electric resistance heating element of the heating apparatus, a connector section arranged for being electrically connected on its one end side with an electrical power supply and on its other end side with the mounting and reception section, and a thermal fuse unit for detecting an excess temperature of the heating apparatus, which is in heat transfer contact with at least the mounting and reception section and which is connected in the electric supply circuit for supplying the electric resistance heating element of the heating apparatus with electricity. The mounting and reception section comprises a cavity for receiving the thermal fuse unit.

14 Claims, 5 Drawing Sheets

(51) Int. Cl.

| | |
|---|---|
| ***H01H 37/76*** | (2006.01) |
| ***H05B 3/48*** | (2006.01) |
| ***D06F 39/04*** | (2006.01) |
| ***F24H 9/20*** | (2006.01) |

(52) U.S. Cl.
CPC ..... *F24H 9/2071* (2013.01); *H01H 37/761* (2013.01); *H05B 3/48* (2013.01); *H01H 2037/762* (2013.01); *H05B 2203/016* (2013.01)

(58) Field of Classification Search
CPC ..... D06F 39/008; D06F 39/04; H01H 37/761; H01H 2037/762; H01H 37/76; H01H 11/00; H01H 85/36; H05B 3/48; H05B 2203/016; H05B 1/02; H05B 3/10; H05B 6/48; H05B 3/40; H01C 17/02; H01R 4/14; H01R 4/16; H01R 13/68
USPC ..... 392/451, 392, 497, 480; 219/331, 517, 219/510, 544, 336, 523, 494; 337/405, 337/401, 416, 205
See application file for complete search history.

(56) References Cited

FOREIGN PATENT DOCUMENTS

| | | | |
|---|---|---|---|
| CN | 101764005 | A | 6/2010 |
| CN | 101630610 | B | 6/2011 |
| CN | 202759602 | U | 2/2013 |
| DE | 32 49 500 | C2 | 10/1985 |
| DE | 42 43 894 | A1 | 7/1993 |
| EP | 0 086 465 | A1 | 8/1983 |
| EP | 0 651 589 | A2 | 5/1995 |
| GB | 2 098 436 | A | 11/1982 |
| WO | 2008/071794 | A1 | 6/2008 |
| WO | 2011/151303 | A1 | 12/2011 |

* cited by examiner

TERMINAL DEVICE FOR A TUBULAR HEATING DEVICE WITH INTEGRATED FUSE

BACKGROUND

Technical Field

The present invention relates to a terminal device for connecting a heating apparatus, particularly a tubular heating apparatus for household appliances, with an electricity supply wherein the heating apparatus includes at least one electric resistance heating element, and to a heating apparatus including this terminal device. More precisely, the present invention relates to a terminal device for connecting a heating apparatus, in particular for a tubular heating apparatus for household appliances, with an electricity supply wherein the heating apparatus includes at least one electric resistance heating element, and wherein the terminal device comprises a mounting and reception section arranged for being electrically connected with the electric resistance heating element of the heating apparatus, a connector section arranged for being electrically connected on its one end side with an electrical power supply and on its other end side with the mounting and reception section, and a thermal fuse unit for detecting an excess temperature of the heating apparatus, which is in heat transfer contact with at least the mounting and reception section and which is connected in the electric supply circuit for supplying the electric resistance heating element of the heating apparatus with electricity.

The terminal device of the present invention is intended for a heating apparatus which can be used, for example, in household appliances, like washing machines or dishwashers. The water as a liquid medium used therein has to be heated wherein the heating apparatus applied for this are of the electrical resistance heating type. Current from an electricity supply source, usually an electrical household connection, is conducted to one or several heating elements of the heating apparatus having a high electrical resistance and arranged inside a tubular metal sheath in electrically insulating material, such as compressed magnesium oxide powder: The electrically insulating material as well as the tubular sheath or casing, respectively, have a high thermal conductivity. The heating element is usually formed by a relatively thin heating wire profiled in a spiral or coil, respectively. For connecting the thin heating wire inside the heating apparatus with an electricity supply outside the heating apparatus, a terminal device is used which is, for the most part, arranged in the heating apparatus. Usually, the heating apparatus comprises a terminal device at each of the two ends thereof.

For such a heating apparatus, it is necessary to provide a fuse that prevents the heating apparatus from overheating in case the heating apparatus runs dry, i.e., without the cooling of surrounding liquid medium. A dry running of the heating element can carry the risk of fire and incident due to overheating.

Description of the Related Art

From DE patent 32 49 500, it is known to provide a tubular heating apparatus with an overload protection fuse. Therein, a terminal device in form of a pin is provided which comprises a mounting section having an elongated conical shape on which an electric resistance heating element in form of a heating coil is welded, and a reception section designed integrally with the mounting section. A tubular conducting sheath, preferably made of copper, is slid on the reception section and is crimped on or fixed at the reception section. A substantially cylindrical thermal melting fuse is inserted into the tubular conducting sheath from a side opposite to the heating coil and has an electrically and thermal conductive connection with the terminal pin. The melting fuse is electrically connected by means of a cable with an electricity supply outside of the heating apparatus.

This arrangement according to the state of the art brings along several deficiencies. First, the traditional thermal melting fuse has a long reaction time, such that it takes a long time for the fuse to cut the electric supply circuit once an excess temperature has been detected. Additionally, the design according to the prior art presents several elements connected with each other and thus several sources of potential quality issues. For instance, heat transfer between the terminal pin and the melting fuse can be impacted in case of non-reliable contact between the terminal pin and the melting fuse such that heat transfer there between degrades. Next, potential resistance failures can occur between the tubular conducting sheath and both the mounting portion of the terminal pin and the melting fuse inserted within the tubular sheath. Finally, also the crimped connection between the sheath and the melting fuse provides for a potential resistance issue. Since, moreover, in the known heating apparatus several mounting steps are necessary, the assembly of the prior art heating device is laborious and error-prone. Further and more specifically, as for instance the coefficient of heat transfer varies depending on the several connections to be made during assembly, the cut-off times of the melting fuse are widely spread and hardly reproducible.

BRIEF SUMMARY

In light of these deficiencies, it has thus been an object of the present invention to provide a terminal device for a heating apparatus with an integrated thermal fuse unit and a tubular heating apparatus that avoid quality issues, like potential resistance failures and high tolerances in cut-off times, as well as degraded heat transfer caused by additional or unreliable contacts, and which should at the same time bear cost benefits and improvements in the process of manufacturing.

The technical object mentioned above is solved with regard to a terminal device by the features described herein.

In particular, the problem mentioned above is solved by a terminal device for connecting a heating apparatus, in particular a tubular heating apparatus for household appliances, with an electricity supply wherein the heating apparatus includes at least one electric resistance heating element, and wherein the terminal device comprises a mounting and reception section arranged for being electrically connected with the electric resistance heating element of the heating apparatus, a connector section arranged for being electrically connected on its one end side with an electric power supply and on its other end side with the mounting and reception section, and a thermal fuse unit for detecting an excess temperature of the heating apparatus, which is in heat transfer contact with at least the mounting and reception section and which is connected in the electric supply circuit for supplying the electric resistance heating element of the heating apparatus with electricity. Moreover, the mounting and reception section comprises a cavity for receiving at least the thermal fuse unit. Thereby, the mounting and reception section can be designed as an integral component or as separate components being mounted together by a respective assembling procedure, like welding. The mounting and reception section can have the shape of an elongated pin with a right cone at the mounting section side and the cavity on the reception section side.

By providing the mounting and reception section with a cavity, the tubular conducting sheath according to the prior art can be omitted. Accordingly, the probability of potential resistance failures between the heating element and the thermal fuse unit gets reduced, as only one such contact exists. Furthermore, by providing a lower number of components, the manufacturing and assembling process is facilitated and production costs can be reduced.

Moreover, the thermal fuse unit and the mounting and reception section can be pre-assembled before mounted in the heating apparatus. The cavity in the mounting and reception section can be used as a protection for the relatively sensitive thermal fuse unit when shipping the pre-assembled mounting and reception section and the thermal fuse unit to a customer.

The mounting and reception section can be formed in one piece. This reduces the components to be assembled and decreases the mounting costs.

Alternatively, it is possible that the mounting and reception section is formed by a mounting section component and a reception section component wherein the outer diameter of the reception section component is at least substantially equal to or less than the outer diameter of the mounting section component. Thus, the outer diameter of the complete terminal device is not increased by providing two components as is the case with the prior art.

In order to support the attachment and mounting of the reception section component at the mounting section component, it is preferred when the mounting section component comprises at its end facing to the reception section component at least one centering element. The outer contour of the centering element corresponds preferably with the inner contour of the cavity of the reception section component. In case the inner contour of the cavity of the reception section component is a circle, the centering element has the outer contour of a circle and has preferably an outer diameter being at least substantially equal to the inner diameter of the cavity of the reception section component. The reception section component can be fixed to the mounting section component by welding in the area of the centering element.

For the thermal fuse unit which is in particular sensitive temperature, but could additionally or alternatively be sensitive for overcurrent, several designs are possible. In a preferred embodiment, the thermal fuse unit comprises at least one thermal-sensitive pellet element which is provided for melting and cutting-off the electricity supply of the electric resistance heating element of the heating apparatus when at least the temperature of the mounting and reception section exceeds a predetermined temperature. By providing a thermo-sensitive pellet element instead of the classical melting fuse, cut-off times can be drastically reduced. Further and more importantly, cut-off times can be defined sharper, i.e., the spread in cut-off times can be reduced, such that high tolerances in cut-off times can be reduced.

In one development, the melting of the thermo-sensitive pellet element creates a space so that a movement of a contact element of a switch for cutting-off the electricity supply is created.

The predetermined excess temperature can be defined as needed by selecting the appropriate material for the thermo-sensitive pellet element. Suitable materials for the thermo-sensitive pellet element are, for instance, thermoplastic polymers, thermoplastic resins or polyolefine. It has to be noted that the use of a thermo-sensitive pellet element can be provided for other purposes than described in the present specification. Therefore, the use of the thermo-sensitive pellet element is independent from the other design features described previously and in the following.

For establishing a safe interruption of the electricity supply to the heating element of the heating apparatus, it is preferable that the thermal fuse unit comprises at least one movable contact element being arranged in the electricity supply circuit for the electric resistance heating element of the heating apparatus and being urged against the thermo-sensitive pellet element by means of a first elastic element. The contact element is preferably made from a material having good electric conductibility, like, e.g., copper. When the thermo-sensitive pellet element melts due to an excess temperature of at least the mounting and reception section, the movable contact element can be moved by the first elastic element so that the electricity supply to the electric resistance heating element is cut-off. The movable contact element forms thus a part of a switch for cutting-off the electricity supply for the electric resistance heating element.

In a further preferred embodiment, the thermal fuse unit comprises a movable contact element being arranged in the electricity supply circuit for the electric resistance heating element of the heating apparatus and being urged against the connector section by means of a second elastic element. By providing the second elastic element, a safe contact between the movable contact element and the connector section can be established so that the electric resistance heating element can be supplied with electricity via the connector section in a safe way.

For supporting the movement of the movable contact element and thus supporting the switching operation of the switch for interrupting the electricity supply of the electric resistance heating element, it is preferred that the movable contact element has elastic characteristics.

For establishing a safe contact between the movable contact element and the mounting and reception section, it is furthermore preferable when the movable contact element has an outer diameter larger than the inner diameter of the cavity. In case that the movable contact element has elastic characteristics or properties, respectively, the outer circumferential edge area of the movable contact element can be bent such that this outer circumferential area of the movable contact element has a plane contact area to the inner circumferential surface of the cavity. In order to support the elastic characteristics of the movable contact element, it can be provided that the movable contact element has the design of a crown being provided with flexible prongs at its outer circumferential edge area. These prongs can be bent such that they have a close contact to the inner circumferential area of the cavity. The flexibility of the prongs can be achieved by providing the whole contact element with elastic properties or by providing only the prongs with an elastic property. The elasticity of the prongs can be achieved by a respective choice of materials and/or by design.

A compact design of the thermal fuse unit can be achieved by arranging the first and the second elastic element on both sides of the movable contact element. As long as the thermo-sensitive pellet element is not melt, the movable contact element is in close contact to the connector section of the terminal device and is held in a balanced position for establishing an electric supply to the electric resistance heating element of the heating apparatus. For the first and second elastic element, any suitable component can be used. It is preferred when the first and second elastic element are formed by compression springs.

In a further preferred embodiment, it is provided that the connector section comprises a first side end for being connected with the electricity supply for the electric resistance heating element of the heating apparatus and a second side end for being connected with the movable contact element. Thereby, the connector section can have the design of a pin. The one pin end is connected with the electricity supply and the other one is connected with the movable connector element. Thereby, a reliable electricity supply to the electric resistance heating element of the heating apparatus is established.

In a further preferable aspect of the present invention, it is provided that the connector section comprises on its side end facing to the thermal fuse unit, when the thermal device is assembled, a contacting portion having an outer diameter being smaller than the inner diameter of the cavity, and on its free end an end face forming an electrical contacting surface for the movable contact element. By providing the contacting portion having an outer diameter being smaller than the inner diameter of the cavity, a space for receiving further components of the thermal fuse unit is established. Thus, a compact design of the terminal device is possible. By providing the end face forming an electrical contacting surface for the movable contact element, a further part of the switch for interrupting the electricity supply for the electric resistance heating element is provided.

In order to increase the reliability of the terminal device, it is furthermore preferred when the contacting portion is provided on its outer circumferential surface at least partially with an electrically insulating covering. For the covering, any suitable material can be used, like epoxy resins.

For supporting the compact design of the terminal device, it is furthermore preferable when the contacting portion comprises a fixing segment for allowing a mounting of the connector section inside the cavity. This fixing segment can be used to provide a suitable mounting process for connecting the mounting and reception section with the connector section. Such a mounting procedure can be provided by a positive locking between the mounting and reception section and the connector section.

A further compact design of the inventive terminal device can be reached by arranging the first elastic element on the covering of the contacting portion and supporting on a corresponding contour of the contacting portion.

The problem mentioned above as to a tubular heating device is solved by the features described herein.

Since the tubular heating element is provided with a terminal device according to the present invention, a combined tubular heating element and safety device is provided. By implementing the thermal fuse unit in the mounting and reception section of the terminal device according to the present invention, better performance can be achieved with less spread in cut-off times. Accordingly, a stable and well-performing integrated and combined heating and safety element is provided.

Further advantages and preferred embodiments of the present invention will be described in the following together with the drawings listed below. In the following description, the expressions "left," "right," "bottom" and "top" are referred to the drawings in an orientation in which the designation of the figures and the reference signs can be read.

DETAILED DESCRIPTION

A first example of a terminal device 10 for a heating apparatus (not shown) according to the invention will be described in the following with reference to FIGS. 1 to 3*c*.

Figure 1:
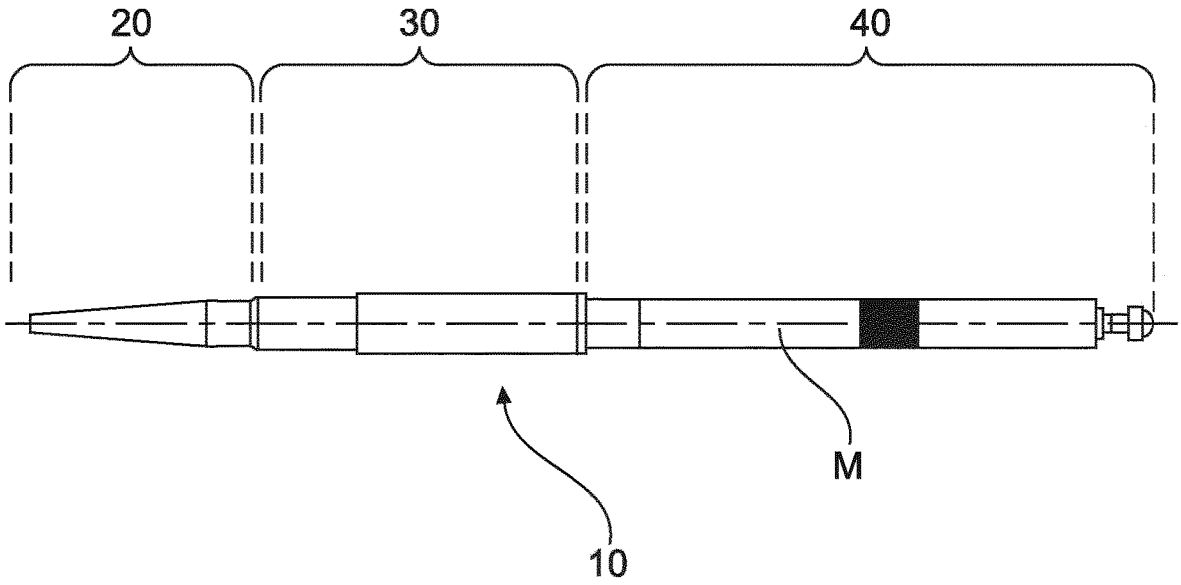
FIG. 1 shows a side view of a first exemplary embodiment of a terminal device according to the invention

As can be seen from FIG. 1, terminal device 10 having center axis M, shows the exterior appearance of a spear or a crossbow bolt, respectively. It comprises a conical mounting section 20 forming the tip of the spear, a cylindrical middle or reception section 30 being a first part of the shaft of the spear, and a cylindrical end or connector section 40 forming the second or remaining part of the shaft of the spear. Moreover, as also can be seen from FIG. 1, the combined axial lengths of mounting section 20 and reception section 30 together is almost equal to the axial length of connector section 40 wherein the axial length of mounting section 20 is shorter than the axial length of reception section 30.

Figure 2A:
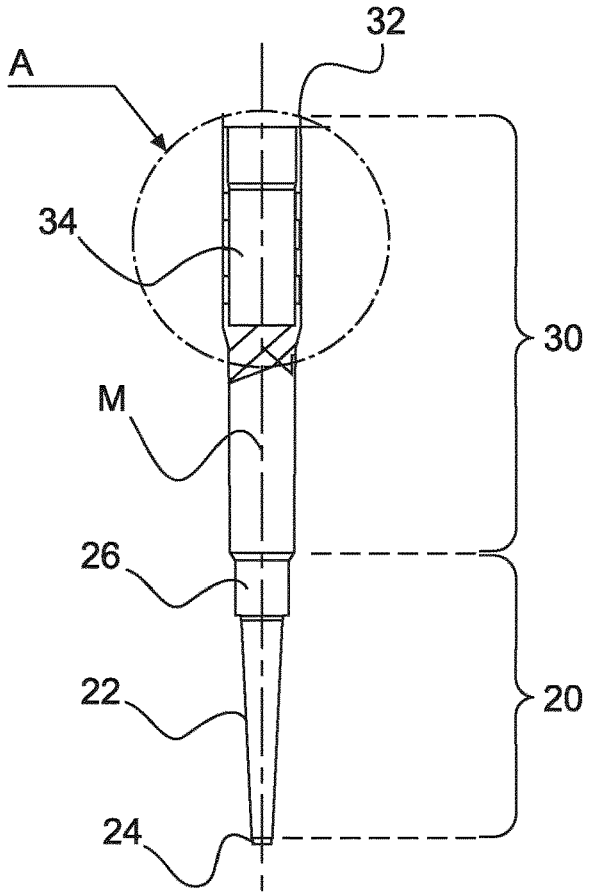
FIG. 2*a* illustrates a conical mounting section and a cylindrical reception section of the terminal device shown in FIG. 1.

Conical mounting section 20 shown in greater detail in FIG. 2*a*, is used for connecting a heating element (not shown) of the heating apparatus, in particular an electric resistance heating element with terminal device 10 and via terminal device 10 with a power source or electricity supply, respectively (not shown). Conical mounting section 20 is formed by a right cone 22 which is symmetrically to central axis M of terminal device 10 and which comprises tip 24. At the end of cone 22 facing in the opposite direction to tip 24 of cone 22 or facing in the direction of reception section 30, respectively, a cylindrical transition portion 26 is integrally arranged with cone 22 which provides a transition from cone 22 to reception section 30. Cylindrical transition portion 26 has an at least substantially circular cross-section and a diameter which is a bit greater than the diameter of the base of right cone 22. Conical mounting section 20 is made from a material of good heat transfer property and high electrical conductivity, like copper or steel.

If the heating element is formed by an electric resistance heating wire being bent in the shape of a spiral or coil, respectively, with an inner diameter larger than the outer diameter of the tip area of cone 22, the coil can be slid on cone 22 with several windings and can be fixed to cone 22 or conical mounting section 20, respectively, for instance by welding, such as laser welding or any other suitable connection or attachment method.

Reception section 30 shown also in greater detail in FIG. 2*a*, is integrally formed with cylindrical transition portion 26 or conical mounting section 20, respectively. In such a case, mounting section 20 and reception section 30 can be combined to one element and can be designated as a mounting and reception section 20, 30. However, in different examples, mounting section 20 and reception section 30 may also be designed as separate components joined together by suitable connection means (cf. FIG. 4), or might include parts comprising or consisting of non-conducting material. In the present embodiment, reception section 30 is made from a material of good heat transfer characteristic and high electrical conductivity, like copper or steel.

Reception section 30 has a cylindrical shape with an at least substantially circular cross-section and with segments having different cylindrical diameters as shown in FIGS. 1 and 2*a*. Reception section 30 comprises on its free end 32 facing to connector section 40, a cavity 34. Cavity 34 has a circular cross-section and extends from end 32 of reception section 30 inside reception section 30. Furthermore, cavity 34 opens towards the outside. Inside cavity 34, a thermal fuse unit 50 can be arranged as explained below in conjunction with FIGS. 3*a* to 3*c*.

Figure 3A:
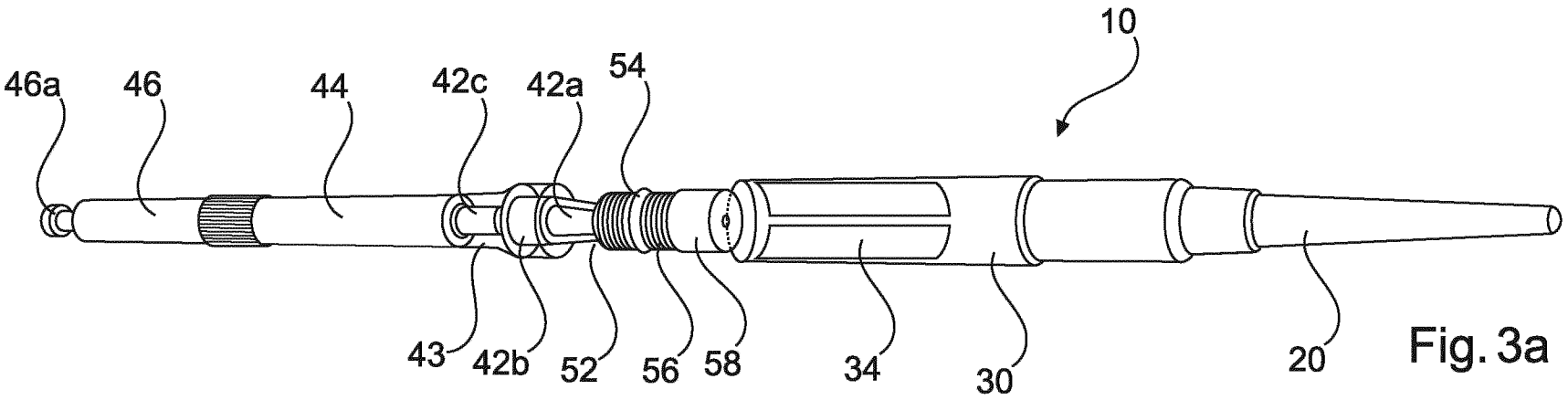
FIG. 3*a* illustrates a three-dimensional perspective and exploded view of the terminal device shown FIG. 1 including a thermal fuse unit.
Figure 3B:
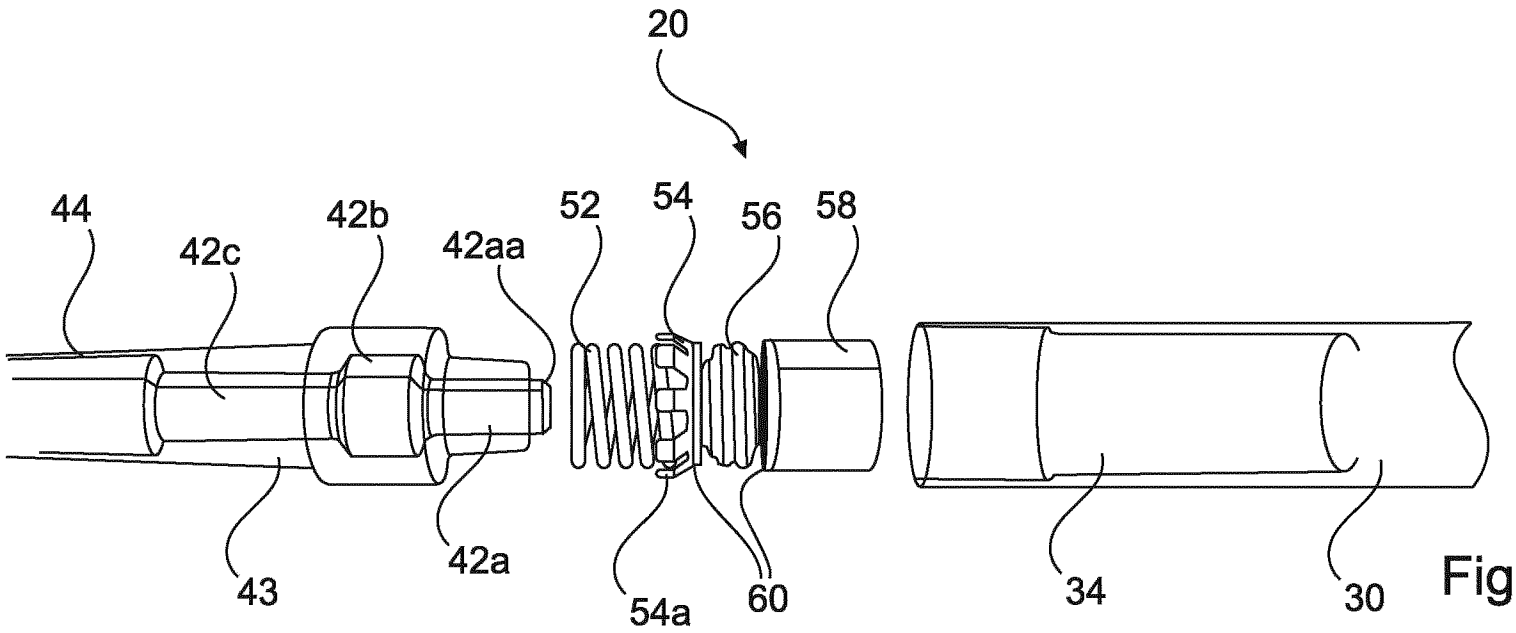
FIG. 3*b* shows a three-dimensional perspective and exploded view of the thermal fuse unit depicted in FIG. 3*a* in more detail.
Figure 3C:
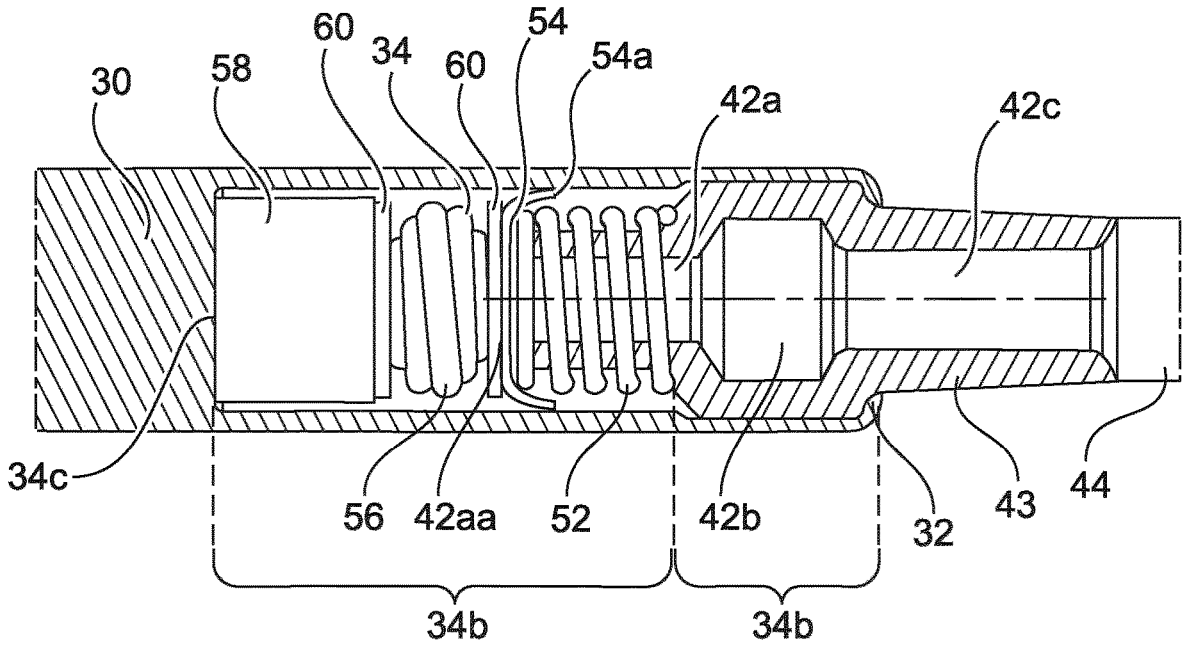
FIG. 3*c* illustrates in greater detail a cross-sectional side view of a part of the reception section marked by circle A in FIG. 2*a* and including the thermal fuse unit of the inventive terminal device.

As can in particular be seen from FIG. 3*c*, cavity 34 comprises in axial direction when starting from free end 32, a first longitudinally extending mounting segment 34*a* and a second longitudinally extending housing segment 34*b* following mounting segment 34*a*. Housing segment 34*b* ends at the end panel 34*c* extending at least substantially vertical to central axis M. Both segments 34*a*, 34*b* have at least substantially circular cross-sections. As can further be seen from FIG. 3*c*, the inner diameter of mounting segment 34*a* is a bit larger than the inner diameter of housing segment 34*b* although the outer diameter of reception section 30 in the area remains unchanged. In other words, the wall thickness of reception section 30 in the area of mounting segment 34*a* is less than in the area of housing segment 34*b*. As also can be seen from FIG. 3*c*, the axial length of mounting segment 34*a* is shorter than the axial length of housing segment 34*b*.

Figure 2B:
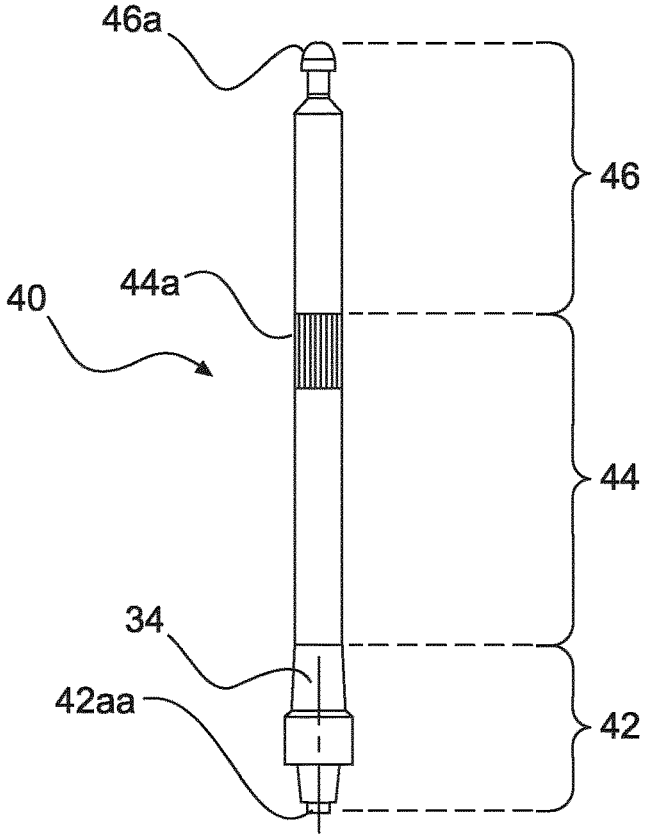
FIG. 2*b* shows a cylindrical connector section of the terminal device shown in FIG. 1.

Connector section 40 shown in greater detail in FIG. 2*b*, has, in consecutive order from bottom to top, a contacting portion 42, a middle portion 44 and a connecting portion 46 wherein middle portion 44 connects contacting portion 42 with connecting portion 46 in an integrally manner. Contacting portion 42 can be arranged at least partially inside cavity 34 when terminal device 10 is assembled. Of course, two or all three portions 42, 44, 46 can be designed as separate components and can be assembled together to form connector section 40. Additionally, connector section 40 or its components, respectively, are made from a material of good heat transfer characteristic and high electrical conductivity, like copper or steel.

As can be seen from FIGS. 3*b* and 3*c*, contacting portion 42 comprises, in consecutive order from left to right, a first pin segment 42*a*, a fixing segment 42*b* and a second pin segment 42*c* which are formed in one piece. First pin segment 42*a*, fixing segment 42*b* and second pin segment 42*c* have at least substantially circular cross-sections. However, the outer diameter of first pin segment 42*a* is a bit smaller than the outer diameter of second pin segment 42*c* whereas the outer diameter of fixing segment 42*b* is relatively large compared to the outer diameters of first and second pin segments 42*a*, 42*c*. Moreover, the axial length of fixing segment 42*b* is shorter that the axial lengths of first and second pin segments 42*a*, 42*c* wherein the axial length of first pin segment 42*a* is shorter than the axial length of second pin segment 42*c*. At least first pin segment 42*a* and fixing segment 42*b* are arranged inside cavity 34 when terminal device 10 is assembled. The transitions between first pin segment 42*a*, fixing segment 42*b* and second pin segment 42*c* have one or several chamfers.

First pin segment 42*a*, fixing segment 42*b* and second pin segment 42*c* are all integral to each other. Of course, two or all segments 42*a*, 42*b*, 42*c* can be designed as separate components and can be assembled to the connector section 40. Additionally, contacting portion 42, or its components, respectively, middle portion 44 and connecting portion 46 are made from a material of good heat transfer characteristic and high electrical conductivity, like copper or steel.

Furthermore, contacting portion 42 is at least substantially completely encased at its outer circumferential surface by an electrically isolating covering 43. The free frontal end 42*aa* of first pin segment 42*a* and preferably a short further area of first pin segment 42*a* extending towards fixing segment 42*b* as can be seen in FIG. 3*b*, which are oriented in the direction towards mounting section 20 and which form an electrical contacting surface, are not covered by covering 43 so that an electrically conducting contact between contacting portion 42 or connector section 40, respectively, and thermal fuse unit 50, in particular a movable contact element 54 of thermal fuse unit 50, can be established as described below. Covering 43 can be made from a plastic material having a sufficient electrically insulating property as well as a sufficient resistance against heat, like poly(p-phenylene sulfide), polyether ether ketones or ceramics.

Covering 43 follows the outer contour of contacting portion 42. In other words, the outer diameter of covering 43 is in the area of fixing segment 42*b* larger than in the area of first and second pin segments 42*a*, 42*c*. By the larger outer diameter of fixing segment 42*b* of contacting portion 42 compared to the outer diameters of first as well as second pin segments 42*a*, 42*c* of connector portion 42, covering 43 is axially fixed. Covering 43 can be mounted to contacting portion 42 in several ways, for example by spraying.

In the area of second pin segment 42*c*, covering 43 has a declining tapered contour extending from fixing segment 42*b* to the end of second pin segment 42*c* facing to middle portion 44. The outer diameter of covering 43 in the area of fixing segment 42*b* is at least substantially equal to the inner diameter of mounting segment 34*a* of cavity 34. The wall thickness of covering 43 in the area of first pin segment 42*a* of contacting portion 42 is smaller than the wall thickness of covering 43 in the area of fixing segment 42*b* and second pin segment 42*c* of contacting portion 42. Thus, when contacting portion 42 of connector section 40 is mounted inside cavity 34, there is a space between the outer circumferential surface of first pin segment 42*a* or covering 43, respectively, and the inner circumferential surface of housing segment 34*b* of cavity 34.

The free end of connecting portion 46 is formed by a contact pin 46*a* for providing an electrical connection between terminal device 10 and thus the heating apparatus as well as an electrical power source or electricity supply, respectively. The electrical connection can, for example, be formed by a plug connection. When terminal device 10 is built in the heating apparatus, connecting portion 46 lies outside the sheath of the heating device whereas contacting portion 42 and middle portion 44 are at least partially arranged inside said sheath. Moreover, at the end of middle portion 44 facing to connecting portion 46, there is arranged a riffle area 44*a* extending at least substantially completely around the circumference of middle portion 44 and provides a fixing area for a sealing element (not shown) which is attached to connector section 40 when mounted to the heating apparatus.

As can best be seen in FIGS. 3*a* to 3*c*, thermal fuse unit 50 is arranged between reception section 30 and connector section 40. In particular, thermal fuse unit 50 is provided inside cavity 34 of reception section 30. Thermal fuse unit 50 comprises, in consecutive order from right to left, a first compression spring 52, a movable contact element or movable contacting plate 54, a second compression spring 56 and a thermo-sensitive pellet element 58.

First compression spring 52 which can, for example, be a coil spring, is arranged on the outer circumference of covering 43 in the area of first pin segment 42*a* of contacting portion 42 and is supported on its side facing to fixing segment 42*b* of contacting portion 42 on the shoulder between first pin segment 42*a* and fixing segment 42*b*. First compression spring 52 acts against contacting plate 54 which is made by an electrical conductive material with some bending capacity. Contacting plate 54 has the shape of a crown including prongs 54*a*. The outer diameter of contacting plate 54 is larger than the inner diameter of the inner circumferential wall of housing segment 34*b* of cavity 34 so that prongs 54*a* of contacting plate 54 forming its circumferential edge area are bent in the direction of connector section 40 as can be seen in FIGS. 3*a* to 3*c*, when thermal fuse unit 50 is mounted in cavity 34. Moreover, contacting plate 54 lies in close contact to free end 42*aa* of first pin segment 42*a* being not covered by covering 43. Through this, an electrical contact is formed from the electricity supply via connector section 40, in particular its contacting portion 42, contacting plate 54 and its prongs 54*a* to reception section 30 and mounting section 20 so that the electric resistance heating element of the heating apparatus can be supplied with electrical energy.

On the side of contacting plate 54 being opposite to its side facing to first compression spring 52, second compression spring 56 which can also be formed by a coil spring, is provided. Second compression spring 56 is tensioned between contacting plate 54 and thermo-sensitive pellet element 58. First and second compression spring 52, 56 exert a pressure force to contacting plate 54 such that contacting plate 54 is held in its position shown in FIG. 3*c*.

Pellet element 58 which comprises a thermo-sensitive material selected depending on required temperature and melting characteristics, and which is formed substantially cylindrical, abuts with its end facing in the opposite direction to second compression spring 56, against end panel 34*c* of cavity 34 and is urged against end panel 34*c* of cavity 34 by first and second compression springs 52, 56 via contacting plate 54. Thus, pellet element 58 is clamped or pressed between end panel 34*c* of cavity 34 and the shoulder of fixing segment 42*b* of contacting portion 42. By this design, heat can be transferred directly from conical mounting section 20 and/or reception section 30 to pellet element 58 without an intermediate element, such as a copper sheath, like in the prior art. Between thermo-sensitive pellet element 58 and second compression spring 56 as well as between second compression spring 56 and contacting plate 54 respective disk-shaped abutting elements 60 can be provided to provide a well defined abutting surface for first and second compression springs 52, 56.

Alternatively or additionally, pellet element 58 can be electrically conductive or comprise an electrical conductor embedded therein. Thus, electrical contact between conical mounting section 20, reception section 30 and connector section 40 can be established via connecting portion 46, middle portion 44, contacting portion 42, in particular second pin segment 42*c*, fixing segment 42*b* and first pin segment 42*a*, as well as contacting plate 54, second compression spring 56 and pellet element 58. In a further example, a conducting wire can be embedded within pellet element 58. Said conducting wire can, for instance, electrically connect to conical mounting section 20 and reception section 30 with contacting plate 54 and/or with first compression spring 52. Current flowing through said conducting wire can support the melting of thermo-sensitive pellet element 58 in case of excess temperature, such that the cut-off time can further be reduced.

However, in a different example, thermo-sensitive pellet element 58 is not electrically conductive and electrical contact between conical mounting section 20, reception section 30, connector section 40 and an electricity supply is only established by means of connecting portion 46, middle portion 44, contacting portion 42, in particular second pin segment 42*c*, fixing segment 42*b* and first pin segment 42*a*, contacting plate 54, reception section 30 and mounting section 20.

When thermal fuse unit 50 has been inserted into cavity 34 such that thermo-sensitive pellet element 58 abuts against end panel 34*a* of cavity 34, free end 32 of reception section 30 can be deformed such that it is crimped around the shoulder of covering 43 in the area of fixing segment 42*b* in order to form a positive locking between free end 32 and thus reception section 30 and fixing segment 42*b* and thus connector portion 40. Thermal fuse unit 50 is fixed inside cavity 34. Simultaneously, mounting section 20 and reception section 30 are joined with connector section 40 so that terminal device 10 is assembled and ready for use. However, any other suitable attachment procedure such as welding is also contemplated by a person skilled in the art.

Next, it will be described how thermo-sensitive pellet element 58 ensures an electrical cut-off of the heating apparatus from an electrical power source upon detection of a predetermined excess temperature. Thermo-sensitive pellet element 58 is in direct contact with end panel 34*c* of cavity 34 of reception section 30. In other words, heat is directly transferred from conical mounting section 20 and/or reception section 30 to thermo-sensitive pellet element 58. In case that there is an excessive heat, i.e., the heating apparatus in which inventive terminal device 10 is mounted, reaches a temperature which is higher than a predetermined temperature, i.e., too high for a normal operation, this heat is directly transferred via mounting section 20 and/or reception section 30 to thermo-sensitive pellet element 58, without any additional heat conducting elements that would introduce heat transmission errors.

Upon reaching a certain temperature which is preferably higher than the usual operating temperature, and is, for instance, 130° C., thermo-sensitive pellet element 58 starts to melt. As pellet element 58 melts, second compression spring 56 is not supported by pellet element 58 anymore and expands into the direction to end panel 34*a* of cavity 34. Due to the expansion, the pressure force applied by second compression spring 56 onto contacting plate 54 decreases. On the other side, first compression spring 52 still applies the same pressure force onto contacting plate 54. Now, the pressure force of first compression spring 52 applied to contacting plate 54 becomes higher than the pressure force of second compression spring 56 applied to contacting plate 54, such that contacting plate 54 moves towards the second compression spring 56 side and is thus separated from free end 42*aa* of first pin segment 42*a*. By moving contacting plate 54 away and apart from free frontal end 42*aa* of first pin segment 42*a*, the electrical connection between conical mounting section 20 and reception section 30 on the one side and connector section 40 on the other side is cut-off and thus also the connection between the electric resistance heating element and the electricity supply.

Figure 4:
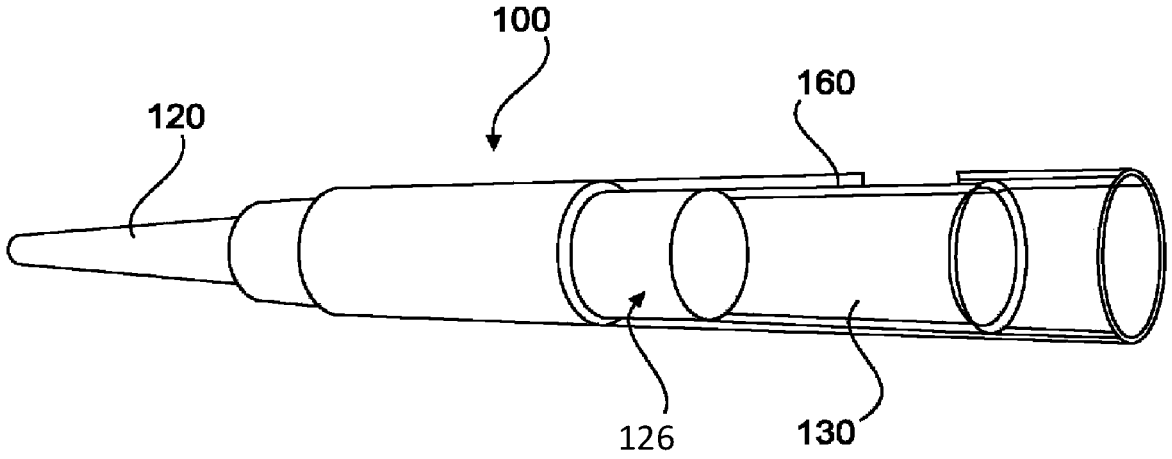
FIG. 4 shows a two-component layout according to a second exemplary terminal device according to the invention.

In the following, a second exemplary terminal device 100 is described with reference to FIG. 4, which illustrates a schematic perspective view thereof. Components of the second embodiment having the same function as the respective component of the first embodiment described above in conjunction with FIGS. 1 to 3*c* are designated with the same reference number increased by 100. Moreover, only the differences between the first embodiment and second embodiment are explained in detail.

Terminal device 100 comprises a conical mounting section component 120 and a reception section component 130 formed as separate elements. Reception section component 130 is formed as a sleeve having an at least substantially constant inner and outer diameter and being open at both ends. The outer diameter of reception section component 130 is at least substantially equal to the outer diameter of mounting component section 120 at least in the contact area of both components 120, 130.

At the end facing to reception section component 130, mounting section component 120 comprises a cylindrical mounting and centering element 126 facing in the direction of not shown connector section 40 when terminal device 100 is assembled. Mounting element 126 has a smaller outer diameter than the circumferential outer diameter of reception section 130. Thermal fuse unit 50 (not shown) is in this example provided within the sleeve forming reception section component 130 which has an inner diameter at least substantially equal to the outer diameter of mounting and centering element 126. Thus, reception section component 130 can be slid on mounting and centering element 126 whereby it is centered and thus aligned against mounting section component 120. Subsequently, it can fixedly be connected with mounting section component 120 such that heat and/or electricity can be conducted from reception section component 130 to mounting section component 120, vice versa, for instance by laser welding or any other suitable welding technologies such as friction welding, or other attachment processes such as crimping, brazing, pressing and the like as known in the art. Reception section component 130 is preferably silver-coated or made of silver.

Upon assembly, tubular reception section component 130 with thermal fuse unit 50 provided therein together with first pin segment 42*a* of contacting portion 42 of connector section 40 is slid over cylindrical mounting and centering element 126 and suitably connected thereto. Thermo-sensitive pellet element 58 is in contact with the end face of mounting and centering element 126. Moreover, prongs 54*a* of movable contacting plate 54 are in contact with the inner circumferential surface of reception section component 130.

The various embodiments described above can be combined to provide further embodiments. Aspects of the embodiments can be modified, if necessary to employ concepts of the various patents, applications and publications to provide yet further embodiments These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A terminal device for connecting a heating apparatus, in particular a tubular heating apparatus for household appliances, with an electricity supply wherein the heating apparatus includes at least one electric resistance heating coil, comprising:

a conical mounting and reception section made of a material of good heat transfer and high electrical connectivity arranged for being electrically connected with the electric resistance heating coil by inserting the mounting and reception section inside the electric resistance heating coil;

a connector section arranged for being electrically connected on a first end side with the electricity supply and on a second end side opposite the first end side along a central axis of the conical mounting and reception section with the mounting and reception section; and a thermal fuse unit for detecting an excess temperature of the heating apparatus, which is in heat transfer contact with at least the mounting and reception section and which is connected in an electricity supply circuit for supplying the electric resistance heating element of the heating apparatus with electricity;

wherein the mounting and reception section comprises a cavity;

wherein the thermal fuse unit is completely recessed in the cavity;

wherein the thermal fuse unit comprises at least one thermo-sensitive pellet element which is provided for melting and cutting-off the electricity supply of the electric resistance heating element of the heating apparatus when the temperature of the mounting and reception section exceeds a predetermined temperature;

wherein the cavity comprises an end panel and the thermo-sensitive pellet element is in direct contact with the end panel of the cavity of the mounting and reception section;

wherein the end panel is a wall of the cavity that is perpendicular to a central axis of the cavity and to the central axis of the conical mounting and reception section;

wherein the connector section fits inside of the cavity of the mounting and reception section and has a tapered end.

2. The terminal device according to claim 1, wherein the mounting and reception section is formed in one piece.

3. The terminal device according to claim 1, wherein the mounting and reception section is formed by a mounting section component and a reception section component wherein the outer diameter of the reception section component is at least substantially equal to or less than the outer diameter of the mounting section component.

4. The terminal device according to claim 3, wherein the mounting section component comprises at its end facing to the reception section component at least one centering element.

5. The terminal device according to claim 1, wherein the thermal fuse unit comprises at least one movable contact element being arranged in the electricity supply circuit for the electric resistance heating element of the heating apparatus and being urged against the thermo-sensitive pellet element by means of a first elastic element.

6. The terminal device according to claim 1, wherein the thermal fuse unit comprises a movable contact element being arranged in the electricity supply circuit for the electric resistance heating element of the heating apparatus and being urged against the connector section by means of a second elastic element.

7. The terminal device according to claim 5, wherein the movable contact element has elastic properties.

8. The terminal device according to claim 5, wherein the movable contact element has an outer diameter larger than the inner diameter of the cavity, wherein an outer circumferential edge area of the movable contact element can be bent such that the outer circumferential edge area of the movable contact element has a plane contact area with the inner circumferential surface of the cavity.

9. The terminal device according to claim 3, wherein the first and the second elastic element are arranged on both sides of the movable contact element.

10. The terminal device according to claim 5, wherein the connector section comprises a first side end for being connected with the electricity supply for the electric resistance heating element of the heating apparatus and a second side end for being connected with the movable contact element.

11. The terminal device according to claim 1, wherein the connector section comprises on its side end facing to the thermal fuse unit when the terminal device is assembled, a contacting portion having an outer diameter being smaller than the inner diameter of the cavity, and on its free end an end face forming an electrical contacting surface for the movable contact element.

12. The terminal device according to claim 11, wherein the contacting portion is provided on its outer circumferential surface at least partially with an electrically insulating covering.

13. The terminal device according to claim 1, wherein the mounting and reception section and the connector section are assembled together by positive locking.

14. A tubular heating apparatus, in particular for household appliances, comprising:

a tubular casing;

at least one electric resistance heating element embedded within an insulating material being provided within the tubular casing; and a terminal device according to claim 1 for connecting the at least electric resistance element of the heating apparatus with an electricity supply.

* * * * *